US012071948B2

(12) United States Patent
Fukaya et al.

(10) Patent No.: US 12,071,948 B2
(45) Date of Patent: Aug. 27, 2024

(54) SCROLL COMPRESSOR HAVING INJECTION PASSAGE CONTAINING MUFFLER

(71) Applicant: KABUSHIKI KAISHA TOYOTA JIDOSHOKKI, Kariya (JP)

(72) Inventors: Yoshihiro Fukaya, Kariya (JP); Shinji Tsubai, Kariya (JP); Yasuaki Nakano, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 18/279,652

(22) PCT Filed: Feb. 25, 2022

(86) PCT No.: PCT/JP2022/007827
§ 371 (c)(1),
(2) Date: Sep. 1, 2023

(87) PCT Pub. No.: WO2022/202092
PCT Pub. Date: Sep. 29, 2022

(65) Prior Publication Data

US 2024/0133378 A1 Apr. 25, 2024
US 2024/0229792 A9 Jul. 11, 2024

(30) Foreign Application Priority Data

Mar. 22, 2021 (JP) ..... 2021-047893

(51) Int. Cl.
*F04C 18/02* (2006.01)
*F04B 39/12* (2006.01)
(Continued)

(52) U.S. Cl.
CPC ..... *F04C 18/0215* (2013.01); *F04C 29/06* (2013.01); *F04C 29/12* (2013.01);
(Continued)

(58) Field of Classification Search
CPC ..... F04C 18/0215; F04C 29/06; F04C 29/12; F04C 29/065; F04C 2210/22;
(Continued)

(56) References Cited

U.S. PATENT DOCUMENTS 6,053,715 A * 4/2000 Hirano ..... F04C 29/0014 418/55.6
2011/0052437 A1* 3/2011 Litsuka ..... F04C 28/26 418/55.1
(Continued)

FOREIGN PATENT DOCUMENTS

JP 52-60909 U 5/1977
JP 2015-129476 A 7/2015
(Continued)

OTHER PUBLICATIONS

International Search Report for PCT/JP2022/007827 dated Apr. 5, 2022 (PCT/ISA/210).

*Primary Examiner* — Dominick L Plakkoottam
*Assistant Examiner* — Paul W Thiede
(74) *Attorney, Agent, or Firm* — Sughrue Mion, PLLC

(57) ABSTRACT

A scroll compressor includes a housing and a compression mechanism. The compression mechanism includes a compression chamber. The housing includes an intermediate pressure chamber into which refrigerant having an intermediate pressure is introduced from an external refrigerant circuit. The intermediate pressure is higher than a suction pressure of refrigerant drawn into the compression chamber and lower than a discharge pressure of the refrigerant discharged from the compression chamber. The intermediate pressure chamber and the compression chamber in a process of compression are connected to each other by an injection passage. The injection passage includes a muffler.

5 Claims, 7 Drawing Sheets

(51) Int. Cl.
*F04C 29/06* (2006.01)
*F04C 29/12* (2006.01)

(52) U.S. Cl.
CPC ..... *F04B 39/123* (2013.01); *F04C 29/065* (2013.01); *F04C 2210/22* (2013.01); *F04C 2240/806* (2013.01); *F04C 2250/10* (2013.01); *F04C 2270/135* (2013.01)

(58) Field of Classification Search
CPC ..... F04C 2240/806; F04C 2250/10; F04C 2270/135; F04B 39/123
See application file for complete search history.

(56) References Cited

U.S. PATENT DOCUMENTS

| | | | | |
|---|---|---|---|---|
| 2015/0192126 | A1* | 7/2015 | Nagano ..... | F04C 18/0215 417/410.5 |
| 2018/0238330 | A1 | 8/2018 | Tsuka | |
| 2019/0316589 | A1 | 10/2019 | Endou et al. | |
| 2021/0301820 | A1* | 9/2021 | Fukaya ..... | F04C 18/0215 |

FOREIGN PATENT DOCUMENTS

| | | | |
|---|---|---|---|
| JP | 6197679 | B2 | 9/2017 |
| WO | 2016/088342 | A1 | 6/2016 |
| WO | 2016/137003 | A1 | 9/2016 |
| WO | 2018/012623 | A1 | 1/2018 |

* cited by examiner

SCROLL COMPRESSOR HAVING INJECTION PASSAGE CONTAINING MUFFLER

CROSS REFERENCE TO RELATED APPLICATIONS

This application is a National Stage of International Application No. PCT/JP2022/007827 filed Feb. 25, 2022, claiming priority based on Japanese Patent Application No. 2021-047893 filed Mar. 22, 2021.

TECHNICAL FIELD

The present disclosure relates to a scroll compressor.

BACKGROUND ART

The scroll compressor includes a housing. The housing includes a suction port into which refrigerant is drawn and a discharge port out of which the refrigerant is discharged. The scroll compressor includes a rotary shaft and a compression mechanism. The rotary shaft is accommodated in the housing and supported by the housing to be rotatable about a rotation axis. The compression mechanism includes a fixed scroll and a movable scroll. The fixed scroll is accommodated in the housing and fixed to the housing. The movable scroll orbits as the rotary shaft rotates. The compression mechanism includes a compression chamber that compresses the refrigerant drawn when the fixed scroll meshes with the movable scroll.

Further, for example, as disclosed in Patent Literature 1, a scroll compressor may include an intermediate pressure chamber into which refrigerant having an intermediate pressure is introduced from an external refrigerant circuit. The intermediate pressure is higher than a suction pressure of the refrigerant drawn into a compression chamber and lower than a discharge pressure of the refrigerant discharged from the compression chamber. The intermediate pressure chamber is defined in the housing. The intermediate pressure chamber and the compression chamber in a process of compression are connected to each other by an injection passage. For example, during high-load operation of the scroll compressor, refrigerant having the intermediate pressure introduced into the intermediate pressure chamber from the external refrigerant circuit is introduced into the compression chamber through the injection passage. This increases the flow rate of the refrigerant in the compression chamber and thus enhances the performance of the scroll compressor during the high-load operation.

CITATION LIST

Patent Literature

Patent Literature 1: Japanese Patent No. 6197679

SUMMARY OF INVENTION

Technical Problem

In such a scroll compressor, pulsation occurs in the compression chamber due to pressure fluctuation in the compression chamber caused when a compression stroke of refrigerant is performed in the compression chamber. When the pulsation that has occurred in the compression chamber is transmitted to the intermediate pressure chamber through the injection passage, the pulsation occurs in the intermediate pressure chamber. Thus, noise that results from the pulsation occurring in the intermediate pressure chamber is produced.

Solution to Problem

A scroll compressor according to an aspect includes a housing including a suction port into which refrigerant is drawn and a discharge port out of which the refrigerant is discharged, a rotary shaft accommodated in the housing and supported by the housing to be rotatable about a rotation axis, and a compression mechanism accommodated in the housing. The compression mechanism includes a fixed scroll fixed to the housing and a movable scroll configured to orbit as the rotary shaft rotates. The compression mechanism includes a compression chamber configured to compress the refrigerant drawn when the fixed scroll meshes with the movable scroll. The housing includes an intermediate pressure chamber into which refrigerant having an intermediate pressure is introduced from an external refrigerant circuit. The intermediate pressure is higher than a suction pressure of the refrigerant drawn into the compression chamber and lower than a discharge pressure of the refrigerant discharged from the compression chamber. The intermediate pressure chamber and the compression chamber in a process of compression are connected to each other by an injection passage. The injection passage includes a muffler.

DESCRIPTION OF EMBODIMENTS

An embodiment of a scroll compressor will now be described with reference to FIGS. 1 to 7. The scroll compressor of the present embodiment is used in, for example, a vehicle air conditioner.

Entire Configuration of Scroll Compressor 10

Figure 1:
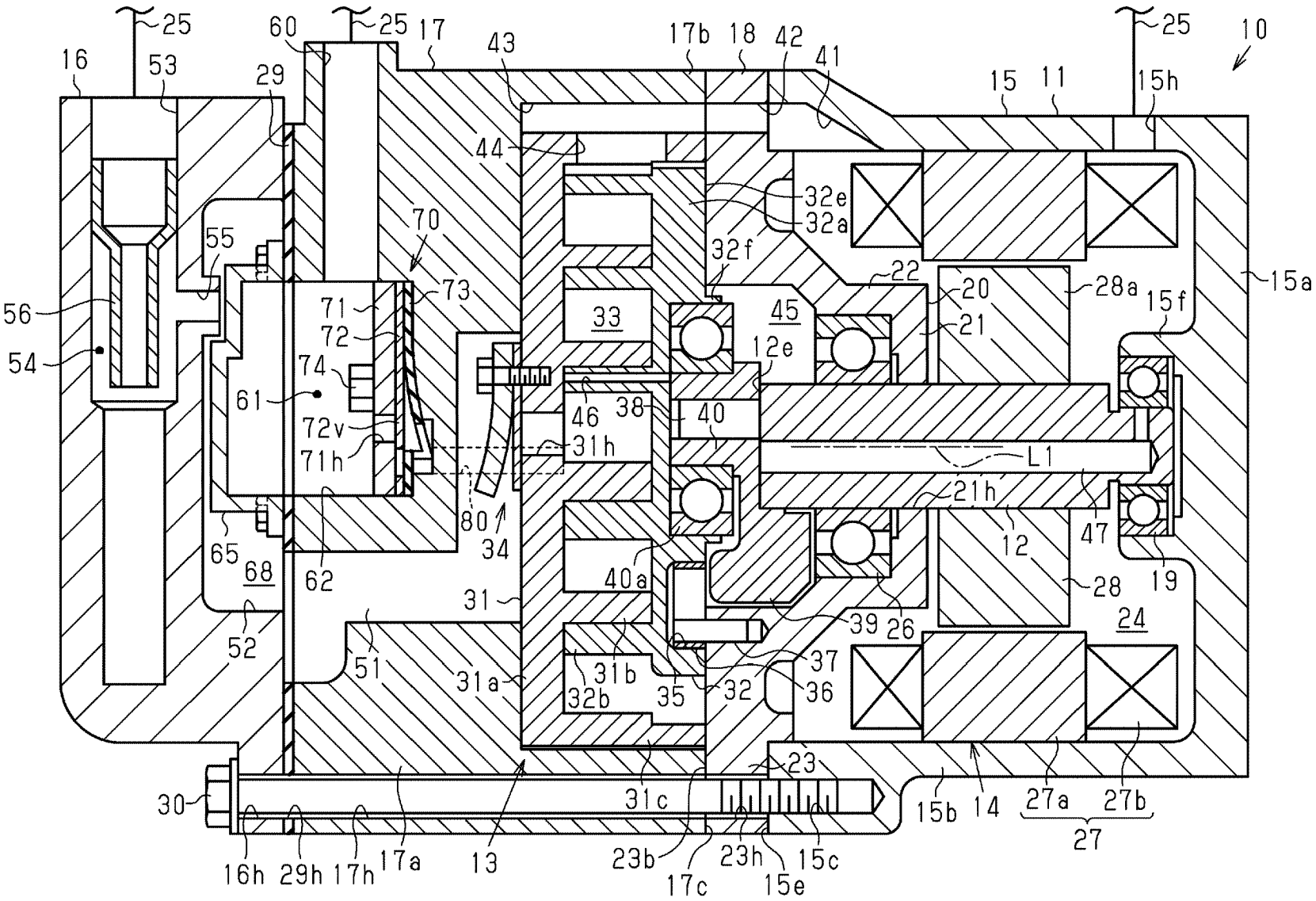
FIG. 1 is a side cross-sectional view showing a scroll compressor according to an embodiment.

As shown in FIG. 1, a scroll compressor 10 includes a cylindrical housing 11, a rotary shaft 12 that is accommodated in the housing 11, a compression mechanism 13 that is driven by rotation of the rotary shaft 12, and an electric motor 14 that rotates the rotary shaft 12. The rotary shaft 12 is supported by the housing 11 to be rotatable about a rotation axis.

The housing 11 includes a motor housing member 15, a discharge housing member 16, an intermediate housing member 17, and a shaft support housing member 18. The motor housing member 15, the discharge housing member 16, the intermediate housing member 17, and the shaft support housing member 18 are each made of a metal material, for example, aluminum.

The motor housing member 15 includes a plate-shaped end wall 15*a* and a cylindrical circumferential wall 15*b* that extends from an outer circumferential portion of the end wall 15*a*. The direction in which the axis of the circumferential wall 15*b* extends coincides with the axial direction of the rotary shaft 12, in which an axis L1 extends. The circumferential wall 15*b* includes an opening end that includes a female threaded hole 15*c*. The motor housing member 15 includes a suction port 15*h*. The suction port 15*h* is located at a portion of the circumferential wall 15*b* closer to the end wall 15*a*. The suction port 15*h* connects the inside and the outside of the motor housing member 15 to each other.

A cylindrical boss 15*f* protrudes from the inner surface of the end wall 15*a*. One end (i.e., a basal end) of the rotary shaft 12 is inserted into the boss 15*f*. A bearing 19 is provided between the inner circumferential surface of the boss 15*f* and the outer circumferential surface of the basal end of the rotary shaft 12. The bearing 19 is, for example, a rolling bearing. The basal end of the rotary shaft 12 is rotationally supported on the motor housing member 15 by the bearing 19.

Figure 2:
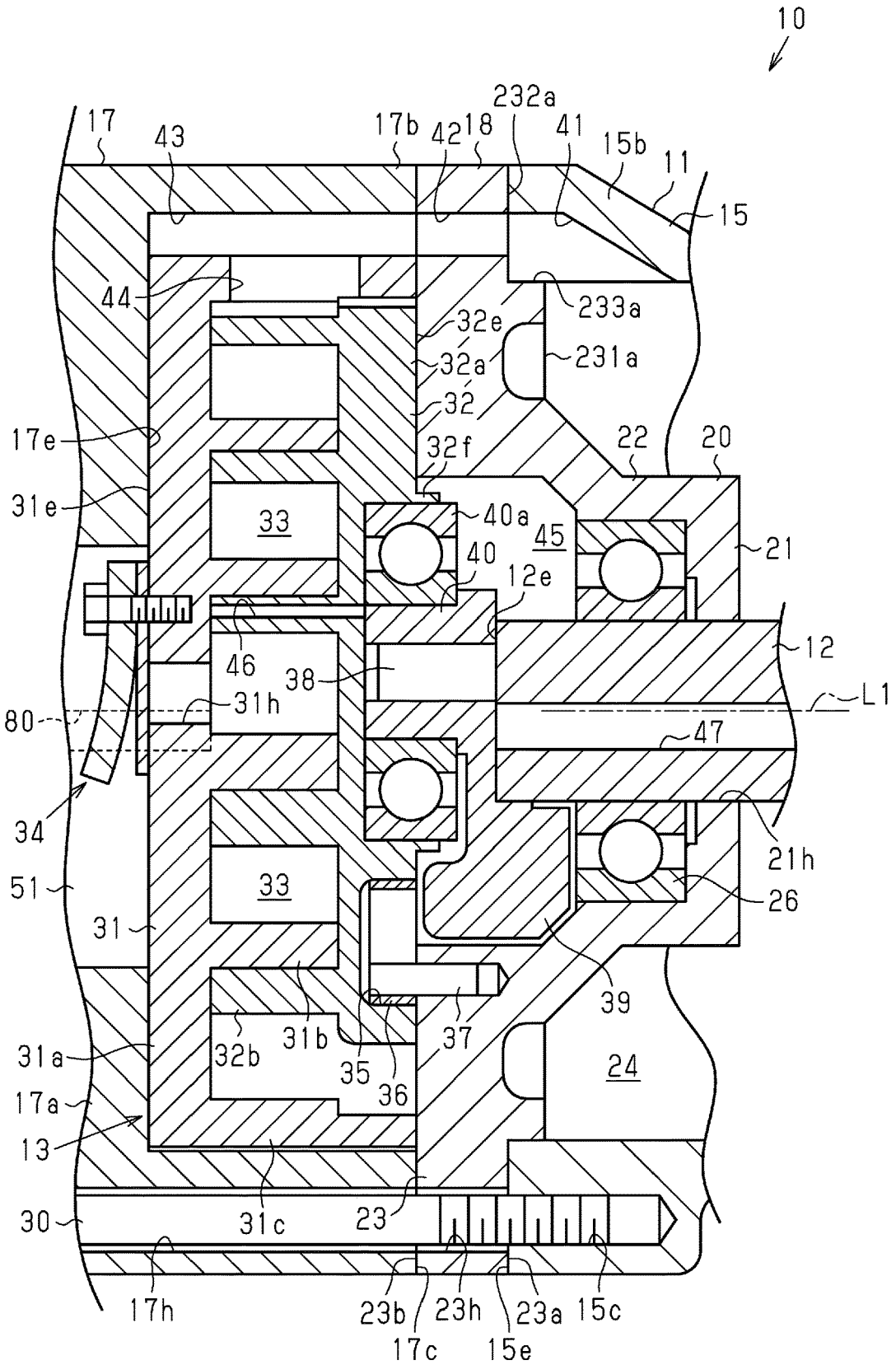
FIG. 2 is an enlarged cross-sectional view showing a part of the scroll compressor.

As shown in FIG. 2, the shaft support housing member 18 includes a cylindrical body 20. The body 20 includes a plate-shaped end wall 21 and a cylindrical circumferential wall 22 that extends from an outer circumferential portion of the end wall 21. The end wall 21 of the body 20 includes a central portion that includes an insertion hole 21*h* through which the rotary shaft 12 is inserted. Thus, the shaft support housing member 18 includes the insertion hole 21*h*, which is circular and through which the rotary shaft 12 is inserted. The insertion hole 21*h* extends through the end wall 21 in its thickness direction. The axis of the insertion hole 21*h* coincides with the axis of the circumferential wall 22.

The shaft support housing member 18 includes an annular flange 23 that extends outward in the radial direction of the rotary shaft 12 from an end of the circumferential wall 22 of the body 20 on a side opposite to the end wall 21. An end surface 23*a* of the flange 23 closer to the end wall 21 includes an annular first surface 231*a* and an annular second surface 232*a* that extend in the radial direction of the rotary shaft 12. The first surface 231*a* is continuous with the outer circumferential surface of the circumferential wall 22 and extends in the radial direction of the rotary shaft 12 from the end of the outer circumferential surface of the circumferential wall 22 on the side opposite to the end wall 21. The second surface 232*a* is located outward from the first surface 231*a* in the radial direction of the rotary shaft 12 and located farther from the end wall 21 than the first surface 231*a* in the axial direction of the rotary shaft 12. The outer circumferential edge of the first surface 231*a* on the outer side in the radial direction of the rotary shaft 12 and the inner circumferential edge of the second surface 232*a* on the inner side in the radial direction of the rotary shaft 12 are connected to each other by an annular stepped surface 233*a* that extends in the axial direction of the rotary shaft 12.

The second surface 232*a* of the flange 23 faces an opening end surface 15*e* of the circumferential wall 15*b* of the motor housing member 15. The outer circumferential portion of the flange 23 includes a bolt insertion hole 23*h*. The bolt insertion hole 23*h* extends through the flange 23 in the thickness direction. The bolt insertion hole 23*h* opens in the second surface 232*a* of the flange 23. The bolt insertion hole 23*h* is connected to the female threaded hole 15*c* of the motor housing member 15. The motor housing member 15 and the shaft support housing member 18 define a motor chamber 24 that is included in the housing 11. Refrigerant is drawn into the motor chamber 24 from the external refrigerant circuit 25 through the suction port 15*h*. Thus, the motor chamber 24 is a suction chamber into which refrigerant is drawn from the suction port 15*h*. Refrigerant is drawn into the suction port 15*h*.

An end surface 12*e* on a distal side of the rotary shaft 12 is located inside the circumferential wall 22 of the body 20. A bearing 26 is provided between the inner circumferential surface of the circumferential wall 22 and the outer circumferential surface of the rotary shaft 12. The bearing 26 is, for example, a rolling bearing. The rotary shaft 12 is rotationally supported on the shaft support housing member 18 by the bearing 26. Thus, the shaft support housing member 18 rotationally supports the rotary shaft 12.

As shown in FIG. 1, the electric motor 14 is accommodated in the motor chamber 24. Thus, the motor housing member 15 accommodates the electric motor 14. The electric motor 14 includes a cylindrical stator 27 and a rotor 28 that is disposed inside the stator 27. The rotor 28 rotates integrally with the rotary shaft 12. The stator 27 surrounds the rotor 28. The rotor 28 includes a rotor core 28*a* that is fixed to the rotary shaft 12 and permanent magnets (not shown) that are located in the rotor core 28*a*. The stator 27 includes a cylindrical stator core 27*a* that is fixed to the inner circumferential surface of the circumferential wall 15*b* of the motor housing member 15 and a coil 27*b* that is wound around the stator core 27*a*. When electric power controlled by an inverter device (not shown) is supplied to the coil 27*b*, the rotor 28 rotates so that the rotary shaft 12 rotates integrally with the rotor 28.

The intermediate housing member 17 includes a plate-shaped end wall 17*a* and a cylindrical circumferential wall 17*b* that extends from an outer circumferential portion of the end wall 17*a*. The direction in which the axis of the circumferential wall 17*b* extends coincides with the axial direction of the rotary shaft 12. An opening end surface 17*c* of the circumferential wall 17*b* of the intermediate housing member 17 faces an end surface 23*b* of the flange 23 on a side opposite to the end wall 21. The intermediate housing member 17 includes an outer circumferential portion that includes a bolt insertion hole 17*h* that is connected to the bolt insertion hole 23*h* of the flange 23. The bolt insertion hole 17*h* extends through the end wall 17*a* and the circumferential wall 17*b*.

The discharge housing member 16 has the form of a block. The discharge housing member 16 is attached to an end surface of the end wall 17*a* of the intermediate housing member 17 on a side opposite to the circumferential wall 17*b* by a plate-shaped gasket 29. The gasket 29 seals a section between the discharge housing member 16 and the intermediate housing member 17. The gasket 29 includes an outer circumferential portion that includes a bolt insertion hole 29*h* that is connected to the bolt insertion hole 17*h* of the intermediate housing member 17. Further, the discharge housing member 16 includes an outer circumferential portion that includes a bolt insertion hole 16*h* that is connected to the bolt insertion hole 29*h* of the gasket 29.

A bolt 30 that passes through the bolt insertion holes 16*h*, 17*h*, 23*h*, 29*h* are fastened into the female threaded hole 15*c* of the motor housing member 15. This connects the shaft support housing member 18 to the circumferential wall 15*b* of the motor housing member 15 and connects the intermediate housing member 17 to the flange 23 of the shaft support housing member 18. Further, this connects the discharge housing member 16 to the intermediate housing member 17 with the gasket 29 located in between. Thus, the motor housing member 15, the shaft support housing member 18, the intermediate housing member 17, and the discharge housing member 16 are arranged in this order in the axial direction of the rotary shaft 12.

The flange 23 is held between the circumferential wall 17*b* of the intermediate housing member 17 and the circumferential wall 15*b* of the motor housing member 15. A plate-shaped gasket (not shown) is disposed between the outer circumferential portion of the flange 23 and the opening end surface 15*e* of the circumferential wall 15*b* of the motor housing member 15. The gasket seals a section between the flange 23 and the circumferential wall 15*b* of the motor housing member 15. Further, a plate-shaped gasket (not shown) is disposed between the outer circumferential portion of the flange 23 and the opening end surface 17*c* of the circumferential wall 17*b* of the intermediate housing member 17. The gasket seals a section between the flange 23 and the circumferential wall 17*b* of the intermediate housing member 17.

As shown in FIG. 2, the compression mechanism 13 includes a fixed scroll 31 and a movable scroll 32 that faces the fixed scroll 31. The fixed scroll 31 and the movable scroll 32 are disposed inside the circumferential wall 17*b* of the intermediate housing member 17. Thus, the circumferential wall 17*b* of the intermediate housing member 17 covers the compression mechanism 13 on the radially outer side of the rotary shaft 12. Thus, the circumferential wall 17*b* surrounds the compression mechanism 13. The fixed scroll 31 and the movable scroll 32 are accommodated in the housing 11.

The fixed scroll 31 is fixed to the housing 11. The fixed scroll 31 is located closer to the end wall 17*a* of the intermediate housing member 17 than the movable scroll 32 in the axial direction of the rotary shaft 12. The fixed scroll 31 includes a disc-shaped fixed base plate 31*a* and a fixed volute wall 31*b* that extends upright from the fixed base 31*a* toward a side opposite to the end wall 17*a* of the intermediate housing member 17. The fixed scroll 31 further includes a cylindrical fixed outer circumferential wall 31*c* that extends from an outer circumferential portion of the fixed base plate 31*a*. The fixed outer circumferential wall 31*c* surrounds the fixed volute wall 31*b*. The fixed outer circumferential wall 31*c* includes an opening end surface that is located on the opposite side of a distal end surface of the fixed volute wall 31*b* from the fixed base plate 31*a*.

Figure 3:
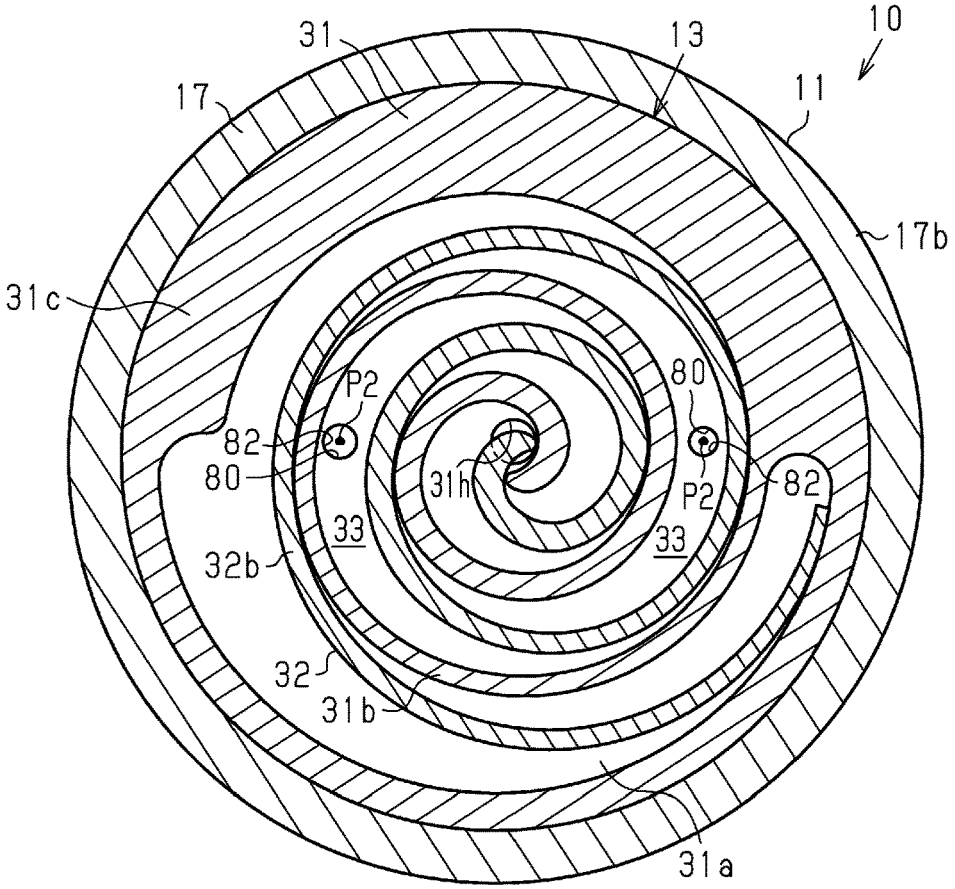
FIG. 3 is a vertical cross-sectional view of the scroll compressor.

As shown in FIGS. 2 and 3, the movable scroll 32 includes a disc-shaped movable base plate 32*a* that faces the fixed base plate 31*a*, and a movable volute wall 32*b* that extends upright from the movable base plate 32*a* toward the fixed base plate 31*a*. The fixed volute wall 31*b* and the movable volute wall 32*b* are meshed with each other. Thus, the movable scroll 32 meshes with the fixed scroll 31. The movable volute wall 32*b* is located inside the fixed outer circumferential wall 31*c*. The distal end surface of the fixed volute wall 31*b* is in contact with the movable base plate 32*a*, and the distal end surface of the movable volute wall 32*b* is in contact with the fixed base plate 31*a*. The fixed base plate 31*a*, the fixed volute wall 31*b*, the fixed outer circumferential wall 31*c*, the movable base plate 32*a*, and the movable volute wall 32*b* define compression chambers 33 that compress the refrigerant drawn. Thus, the compression chambers 33 are defined between the fixed scroll 31 and the movable scroll 32. The compression mechanism 13 includes the compression chambers 33, which compress the refrigerant drawn when the fixed scroll 31 meshes with the movable scroll 32. Then, the compression mechanism 13 discharges the compressed refrigerant.

As shown in FIG. 2, the fixed base plate 31*a* includes a central portion that includes a circular discharge port 31*h*. The discharge port 31*h* extends through the fixed base plate 31*a* in the thickness direction. The discharge port 31*h* opens in an outer end surface 31*e*. The outer end surface 31*e* is an end surface of the fixed base plate 31*a* on a side opposite to the fixed volute wall 31*b*. A discharge valve mechanism 34 that opens and closes the discharge port 31*h* is attached to the outer end surface 31*e* of the fixed base plate 31*a*.

A cylindrical boss 32*f* protrudes from an end surface 32*e* of the movable base plate 32*a* on the side opposite to the fixed base plate 31*a*. The axial direction of the boss 32*f* coincides with the axial direction of the rotary shaft 12. Recesses 35 are disposed around the boss 32*f* of the end surface 32*e* of the movable base plate 32*a*. The recesses 35 are circular. The recesses 35 are arranged at predetermined intervals in the circumferential direction of the rotary shaft 12. An annular ring member 36 is fitted in each recess 35. Pins 37 that are respectively inserted into the ring members 36 protrude from an end surface of the shaft support housing member 18 facing the intermediate housing member 17.

The fixed scroll 31 is positioned with respect to the shaft support housing member 18 in a state in which the fixed scroll 31 is restricted from rotating around the axis L1 of the rotary shaft 12 inside the circumferential wall 17*b* of the intermediate housing member 17. The end surface of the shaft support housing member 18 facing the intermediate housing member 17 is in contact with the opening end surface of the fixed outer circumferential wall 31*c*. The fixed scroll 31 is sandwiched between the end surface of the shaft support housing member 18 facing the intermediate housing member 17 and the end wall 17*a* of the intermediate housing member 17. Thus, the fixed scroll 31 is disposed inside the circumferential wall 17*b* of the intermediate housing member 17 in a state in which the fixed scroll 31 is restricted from moving in the axial direction of the rotary shaft 12 inside the circumferential wall 17*b* of the intermediate housing member 17. Thus, an end surface of the end wall 17*a* of the intermediate housing member 17 adjacent to the circumferential wall 17*b* is a facing surface 17*e* that faces the outer end surface 31*e* of the fixed base plate 31*a*. Thus, the intermediate housing member 17 includes the facing surface 17*e*, which faces the outer end surface 31*e* of the fixed base plate 31*a*.

An eccentric shaft 38 is formed integrally with the end surface 12*e* of the rotary shaft 12 on the distal side. The eccentric shaft 38 protrudes toward the movable scroll 32 from a position that is eccentric with respect to the axis L1 of the rotary shaft 12. The axial direction of the eccentric shaft 38 coincides with the axial direction of the rotary shaft 12. The eccentric shaft 38 is inserted into the boss 32*f*.

A bushing 40 that is integrated with a balance weight 39 is fitted on the outer circumferential surface of the eccentric shaft 38. The balance weight 39 is formed integrally with the bushing 40. The balance weight 39 is accommodated in the circumferential wall 22 of the shaft support housing member 18. The movable scroll 32 is supported on the eccentric shaft 38 by the bushing 40 and a roller bearing 40*a* to be rotatable relative to the eccentric shaft 38.

The rotation of the rotary shaft 12 is transmitted to the movable scroll 32 through the eccentric shaft 38, the bushing 40, and the roller bearing 40*a*. This causes the movable scroll 32 to rotate. When the pins 37 are respectively in contact with the inner circumferential surfaces of the ring members 36, the movable scroll 32 is prevented from rotating and only the orbiting of the movable scroll 32 is allowed. Thus, the movable scroll 32 orbits as the rotary shaft 12 rotates. Further, when the movable scroll 32 orbits with the movable volute wall 32*b* in contact with the fixed volute wall 31*b*, the volume of the compression chamber 33 decreases, thereby compressing refrigerant. Thus, the compression mechanism 13 is driven by the rotation of the rotary shaft 12. The balance weight 39 cancels a centrifugal force acting on the movable scroll 32 when the movable scroll 32 orbits, thereby reducing the amount of imbalance in the movable scroll 32.

A part of the inner circumferential surface of the circumferential wall 15*b* of the motor housing member 15 includes a first groove 41. The first groove 41 opens in the opening end of the circumferential wall 15*b*. Further, the outer circumferential portion of the flange 23 of the shaft support housing member 18 includes a first hole 42 that is connected to the first groove 41. The first hole 42 extends through the flange 23 in the thickness direction. Furthermore, a part of the inner circumferential surface of the circumferential wall 17*b* of the intermediate housing member 17 includes a second groove 43 that is connected to the first hole 42. The fixed outer circumferential wall 31*c* of the fixed scroll 31 includes a second hole 44 that extends through the fixed outer circumferential wall 31*c* in the thickness direction. The second hole 44 is connected to the second groove 43. The second hole 44 is connected to the outermost circumferential portion of the compression chamber 33.

Then, the refrigerant in the motor chamber 24 passes through the first groove 41, the first hole 42, the second groove 43, and the second hole 44 and is drawn into the outermost circumferential portion of the compression chamber 33. The refrigerant drawn into the outermost circumferential portion of the compression chamber 33 is compressed in the compression chambers 33 by the orbiting of the movable scroll 32.

The housing 11 includes a back pressure chamber 45. The back pressure chamber 45 is located inside the circumferential wall 22 of the shaft support housing member 18. Thus, the back pressure chamber 45 is located at a position in the housing 11 on the opposite side of the movable base plate 32*a* from the fixed base plate 31*a*. The shaft support housing member 18 defines the back pressure chamber 45 and the motor chamber 24.

The movable scroll 32 includes a back pressure introduction passage 46 that extends through the movable base plate 32*a* and the movable volute wall 32*b* and introduces the refrigerant in the compression chambers 33 into the back pressure chamber 45. The back pressure chamber 45 is higher in pressure than the motor chamber 24 because the refrigerant in the compression chambers 33 is introduced into the back pressure chamber 45 through the back pressure introduction passage 46. An increase in the pressure of the back pressure chamber 45 causes the movable scroll 32 to be biased toward the fixed scroll 31 such that the distal end surface of the movable volute wall 32*b* is pressed against the fixed base plate 31*a*.

The rotary shaft 12 includes an in-shaft passage 47. One end (i.e., distal end) of the in-shaft passage 47 opens in the end surface 12*e* of the rotary shaft 12. The other end (i.e., basal end) of the in-shaft passage 47 opens in a part of the outer circumferential surface of the rotary shaft 12 that is supported by the bearing 19. Thus, the in-shaft passage 47 connects the back pressure chamber 45 to the motor chamber 24.

As shown in FIG. 1, the end wall 17*a* of the intermediate housing member 17 includes a discharge passage 51 that is connected to the discharge port 31*h*. The discharge passage 51 opens in the outer surface of the end wall 17*a* of the intermediate housing member 17. The end surface of the discharge housing member 16 closer to the intermediate housing member 17 includes a discharge chamber defining recess 52. The interior of the discharge chamber defining recess 52 is connected to the discharge passage 51. The discharge housing member 16 includes a discharge port 53 and an oil separation chamber 54 that is connected to the discharge port 53. Further, the discharge housing member 16 includes a passage 55 that connects the interior of the discharge chamber defining recess 52 to the oil separation chamber 54. The oil separation chamber 54 includes an oil separation cylinder 56.

The intermediate housing member 17 includes an introduction port 60. Refrigerant having an intermediate pressure is introduced into the introduction port 60 from the external refrigerant circuit 25. Further, the intermediate housing member 17 includes an accommodating recess 62. The accommodating recess 62 is connected to the introduction port 60. The accommodating recess 62 is located on the end surface of the intermediate housing member 17 closer to the discharge housing member 16. The accommodating recess 62 has the form of a generally rectangular hole as viewed from above. The opening of the accommodating recess 62 faces the discharge chamber defining recess 52.

Figure 4:
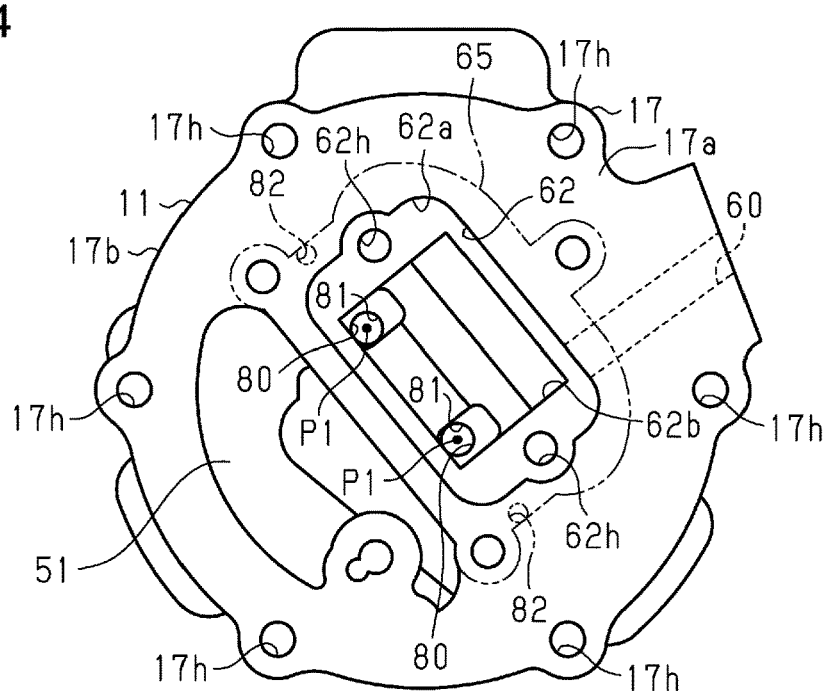
FIG. 4 is a plan view of an intermediate housing member.

As shown in FIG. 4, the accommodating recess 62 includes a first recess portion 62*a* and a second recess portion 62*b* that is located on a bottom surface of the first recess portion 62*a*. The bottom surface of the first recess portion 62*a* includes two female threaded holes 62*h*.

Configuration of Check Valve 70

Figure 5:
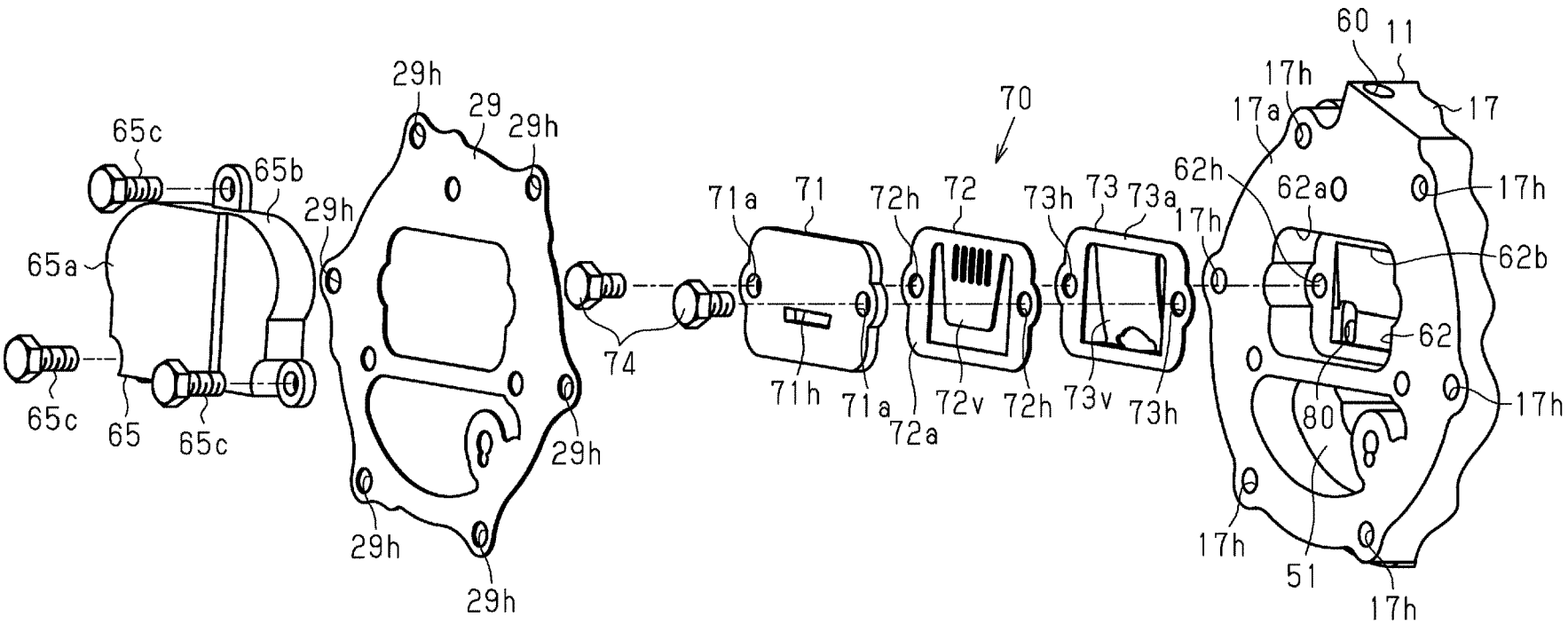
FIG. 5 is an exploded perspective view showing a part of the scroll compressor.

As shown in FIG. 5, the scroll compressor 10 includes a check valve 70. The check valve 70 is accommodated in the accommodating recess 62. Thus, the intermediate housing member 17 accommodates the check valve 70. The check valve 70 includes a valve plate 71, a reed valve forming plate 72, and a retainer forming plate 73.

The valve plate 71 has the form of a flat plate. The valve plate 71 is made of a metal material, for example, iron. The valve plate 71 is shaped along the inner surface of the first recess portion 62*a*. The valve plate 71 includes a central portion that includes a single valve hole 71*h*. The valve hole 71*h* is rectangular as viewed from above. The valve hole 71*h* extends through the valve plate 71 in the thickness direction. The valve plate 71 includes an outer circumferential portion that includes two bolt insertion holes 71*a*.

The reed valve forming plate 72 has the form of a thin flat plate. The reed valve forming plate 72 is made of a metal material, for example, iron. The reed valve forming plate 72 is shaped along the inner surface of the first recess portion 62*a*. The reed valve forming plate 72 includes an outer frame 72*a* and a reed valve 72*v* that protrudes from a part of an inner circumferential edge of the outer frame 72*a* toward a central portion of the outer frame 72*a*. The reed valve 72*v* is trapezoidal as viewed from above. The reed valve 72*v* includes a distal end that is sized to cover the valve hole 71*h*. This allows the reed valve 72*v* to open and close the valve hole 71*h*. The outer frame 72*a* includes two bolt insertion holes 72*h*.

The retainer forming plate 73 has the form of a thin flat plate. The retainer forming plate 73 is made of a rubber material. The retainer forming plate 73 is shaped along the inner surface of the first recess portion 62*a*. The retainer forming plate 73 includes an outer frame 73*a* and a retainer 73*v*. The retainer 73*v* protrudes in a curved manner from a part of an inner circumferential edge of the outer frame 73*a* and regulates the open degree of the reed valve 72*v*. The retainer 73*v* is accommodated in the second recess portion 62*b*. The outer frame 73*a* includes two bolt insertion holes 73*h*.

The retainer forming plate 73, the reed valve forming plate 72, and the valve plate 71 are arranged in this order on the bottom surface of the first recess portion 62*a*. With the retainer forming plate 73, the reed valve forming plate 72, and the valve plate 71 accommodated in the first recess portion 62*a*, the bolt insertion holes 71*a*, 72*h*, 73*h* overlap each other. When fastening bolts 74 inserted through the bolt insertion holes 71*a*, 72*h*, 73*h* are screwed into the female threaded holes 62*h*, the retainer forming plate 73, the reed valve forming plate 72, and the valve plate 71 are fastened to the bottom surface of the first recess portion 62*a*.

Intermediate Pressure Chamber 61

Figure 6:
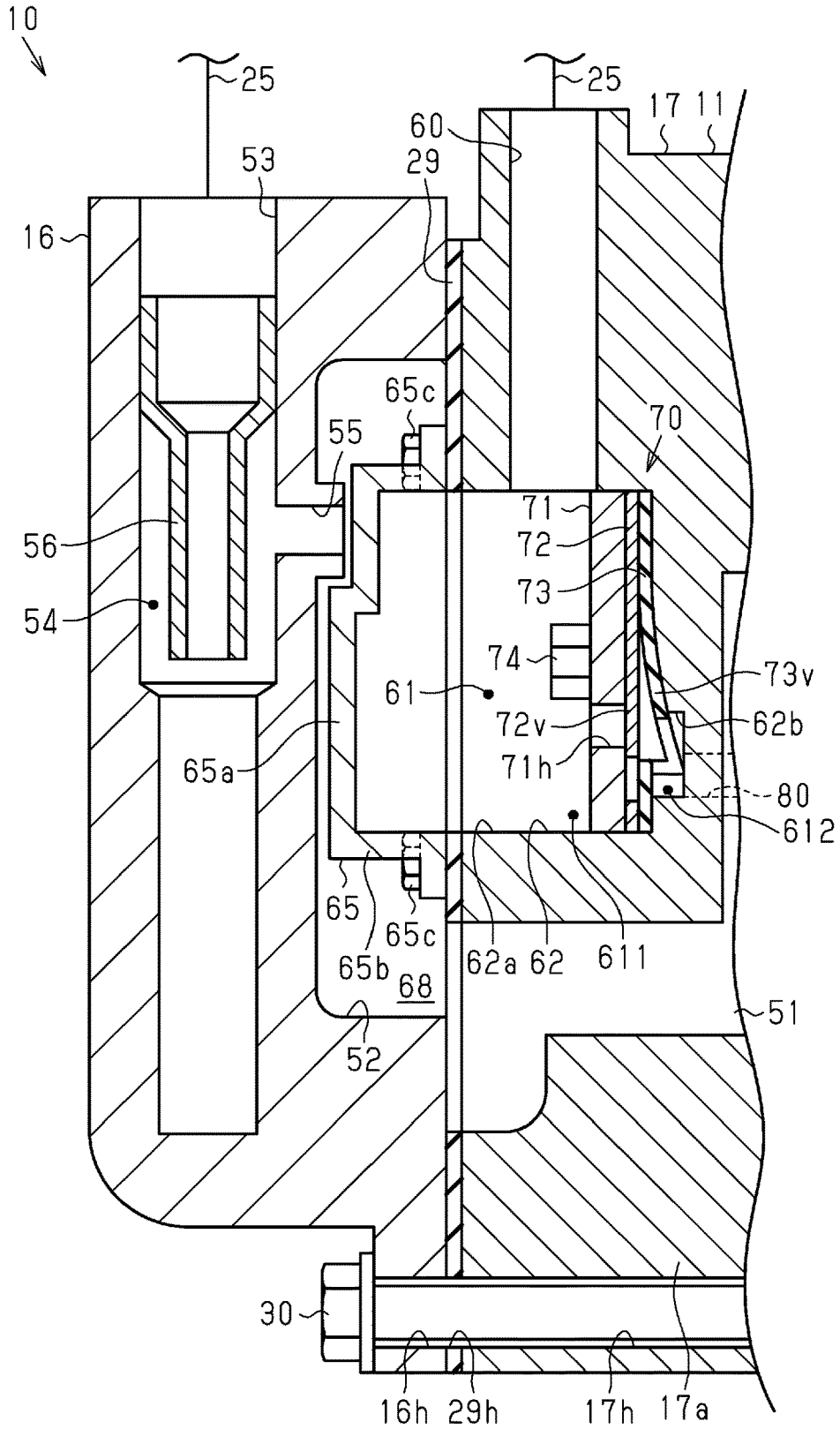
FIG. 6 is an enlarged cross-sectional view showing a part of the scroll compressor.

As shown in FIG. 6, the introduction port 60 opens in the inner surface of the first recess portion 62*a*, and is located at a position that is orthogonal to the axis L1 of the rotary shaft 12 and is closer to the discharge housing member 16 than the valve plate 71. A lid member 65 that closes the opening of the accommodating recess 62 is attached to the intermediate housing member 17. The lid member 65 includes a plate-shaped lid member end wall 65*a* and a cylindrical lid member circumferential wall 65*b* that extends from an outer circumferential portion of the lid member end wall 65*a*. The lid member 65 is fastened to the intermediate housing member 17 with fastening bolts 65*c*. The lid member 65 is disposed inside the discharge chamber defining recess 52. A portion of the gasket 29 is used to seal a section between the lid member 65 and the intermediate housing member 17. Thus, the gasket 29 seals a section between the interior of the accommodating recess 62 and the discharge chamber defining recess 52.

The gasket 29, the discharge chamber defining recess 52, and the lid member 65 define a discharge chamber 68. Thus, the discharge housing member 16 includes the discharge chamber 68. The accommodating recess 62 faces the discharge chamber 68. Further, the gasket 29, the accommodating recess 62, and the lid member 65 define the intermediate pressure chamber 61. Thus, the intermediate housing member 17 includes the intermediate pressure chamber 61. The lid member 65 separates the intermediate pressure chamber 61 from the discharge chamber 68. The check valve 70 is located in the intermediate pressure chamber 61.

The discharge chamber 68 is connected to the discharge passage 51. The refrigerant compressed in the compression chambers 33 is discharged into the discharge chamber 68 through the discharge port 31*h* and the discharge passage 51. Thus, the refrigerant having a discharge pressure is discharged from the compression mechanism 13 into the discharge chamber 68. The refrigerant discharged to the discharge chamber 68 flows into the oil separation chamber 54 through the passage 55. The oil contained in the refrigerant is separated from the refrigerant in the oil separation chamber 54 by the oil separation cylinder 56. Then, the refrigerant from which the oil has been separated is discharged from the discharge port 53 to the external refrigerant circuit 25. Thus, the refrigerant is discharged out of the discharge port 53.

The interior of the intermediate pressure chamber 61 is partitioned by the valve plate 71 into a first chamber 611 that is connected to the introduction port 60 and a second chamber 612 that is located closer to the bottom surface of the first recess portion 62*a* than the valve plate 71. The first chamber 611 is defined by the valve plate 71, the inner surface of the first recess portion 62*a*, and the lid member 65. The second chamber 612 is defined by the valve plate 71 and the second recess portion 62*b*. A section between the first chamber 611 and the second chamber 612 is sealed by the outer frame 73*a* of the retainer forming plate 73. The sealing between the first chamber 611 and the second chamber 612 in the outer frame 73*a* of the retainer forming plate 73 is provided by fastening the fastening bolts 74.

Refrigerant having the intermediate pressure is introduced into the intermediate pressure chamber 61 from the external refrigerant circuit 25 through the introduction port 60. The intermediate pressure is higher than a suction pressure of refrigerant drawn into the compression chambers 33 and lower than the discharge pressure of refrigerant discharged from the compression chambers 33.

Configuration of Injection Passage 80

Figure 7:
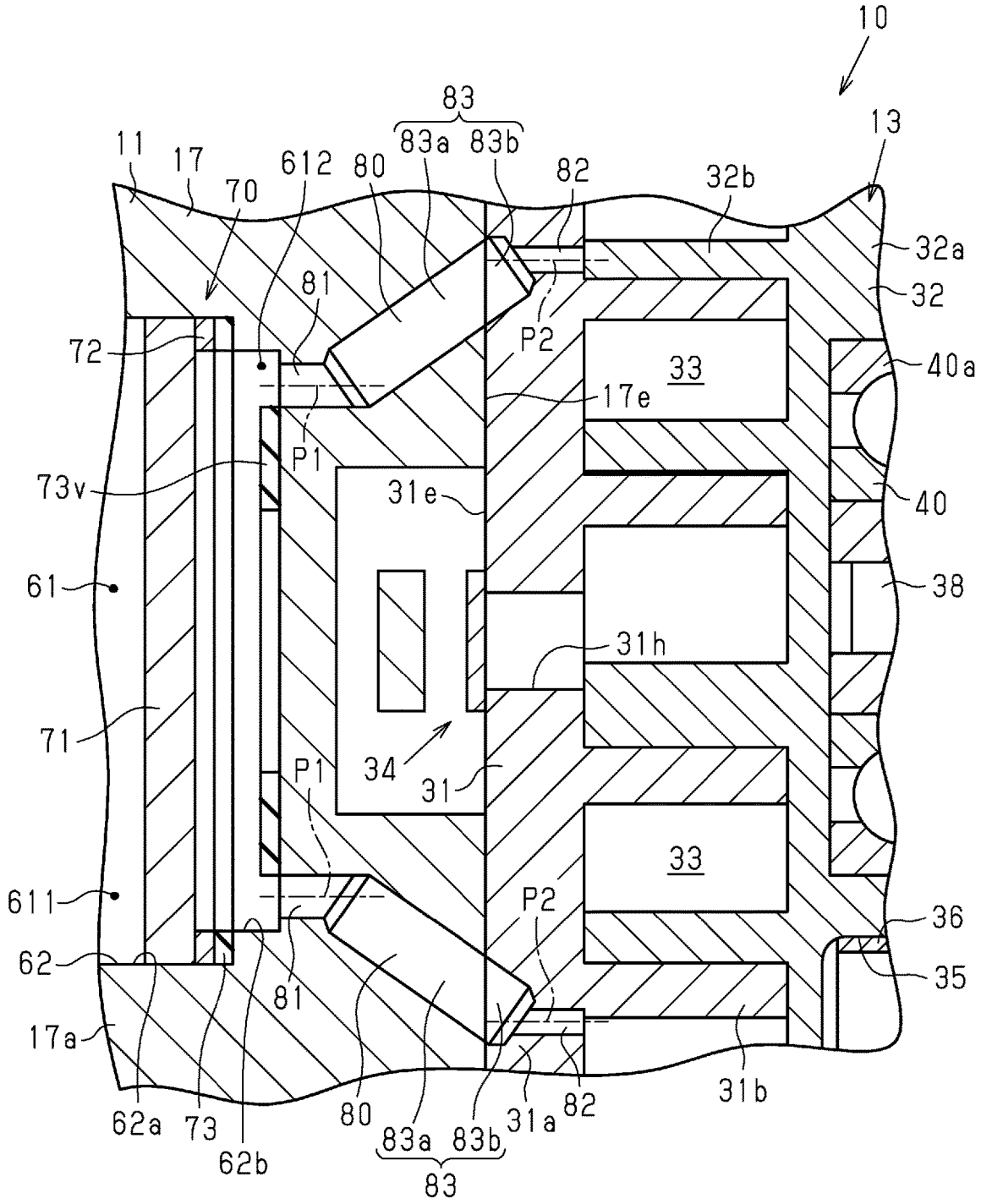
FIG. 7 is an enlarged cross-sectional view showing a part of the scroll compressor.

As shown in FIG. 7, the scroll compressor 10 includes a pair of injection passages 80. Each injection passage 80 causes refrigerant having the intermediate pressure in the intermediate pressure chamber 61 to be introduced into a corresponding compression chamber 33 that is in a process of compression. Thus, the compression chamber 33 in a process of compression and the intermediate pressure chamber 61 are connected to each other by the injection passage 80. The injection passages 80 includes an upstream passage 81, a downstream passage 82, and an intermediate passage 83. Each upstream passage 81 opens in the intermediate pressure chamber 61. Each downstream passage 82 opens in a corresponding compression chamber 33. Each intermediate passage 83 connects a corresponding upstream passage 81 to a corresponding downstream passage 82.

The end wall 17*a* of the intermediate housing member 17 includes the upstream passages 81. One end (i.e., the upstream end) of each upstream passage 81 opens in the bottom surface of the second recess portion 62*b*. Thus, the upstream end of each upstream passage 81 is connected to the second chamber 612 of the intermediate pressure chamber 61. The other end (i.e., the downstream end) of each upstream passage 81 is located inside the end wall 17*a* of the intermediate housing member 17. Each upstream passage 81 is circular. Axes P1 of the upstream passages 81 extend in parallel with each other. The direction in which the axis P1 of each upstream passage 81 extends coincides with the axial direction of the rotary shaft 12.

The fixed base plate 31*a* includes the downstream passages 82. One end (i.e., the downstream end) of each downstream passage 82 opens in a surface of the fixed base plate 31*a* that is adjacent to the movable scroll 32. Thus, the downstream end of each downstream passage 82 is connected to a corresponding compression chamber 33. The other end (i.e., the upstream end) of each downstream passage 82 is located inside the fixed base plate 31*a*. Each downstream passage 82 is circular. Axes P2 of the downstream passages 82 extend in parallel with each other. The direction in which the axis P2 of each downstream passage 82 extends coincides with the axial direction of the rotary shaft 12. Thus, the upstream passages 81 and the downstream passages 82 extend in the same direction.

The length of each upstream passage 81 is substantially equal to the length of a corresponding downstream passage 82. The upstream passage 81 has a larger hole diameter than the downstream passage 82. Thus, the upstream passage 81 has a larger cross-sectional area than the downstream passage 82.

Each intermediate passage 83 includes a first intermediate passage 83*a* and a second intermediate passage 83*b*. The first intermediate passages 83*a* are located in the end wall 17*a* of the intermediate housing member 17. Thus, the upstream passages 81 and the first intermediate passages 83*a* are located in the intermediate housing member 17. One end (i.e., the upstream end) of each first intermediate passage 83*a* is connected to the other end (the downstream end) of a corresponding upstream passage 81. The downstream ends of the first intermediate passages 83*a* open in the facing surface 17*e* of the intermediate housing member 17.

The first intermediate passages 83*a* are circular. Each first intermediate passage 83*a* has a larger hole diameter than a corresponding upstream passage 81. The first intermediate passage 83*a* extends obliquely with respect to the direction in which the axis P1 of the upstream passage 81 extends. Thus, the first intermediate passages 83*a* extend obliquely with respect to the axial direction of the rotary shaft 12. The first intermediate passages 83*a* extend away from each other from the upstream passages 81, respectively, toward the facing surface 17*e* of the intermediate housing member 17. The first intermediate passages 83*a* have a length longer than the upstream passage 81 and longer than the downstream passages 82.

Each second intermediate passage 83*b* is located in the fixed base plate 31*a*. Thus, the downstream passages 82 and the second intermediate passages 83*b* are located in the fixed base plate 31*a*. One end (i.e., the upstream end) of each second intermediate passage 83*b* is connected to the other end (i.e., the upstream end) of a corresponding downstream passage 82. The other end (i.e., the downstream end) of the second intermediate passage 83*b* opens in the outer end surface 31*e* of the fixed base plate 31*a*.

Each second intermediate passage 83*b* is circular. The hole diameter of each second intermediate passage 83*b* is equal to the hole diameter of a corresponding first intermediate passage 83*a*. The second intermediate passage 83*b* extends obliquely with respect to the direction in which the axis P2 of the downstream passage 82 extends. Thus, the second intermediate passage 83*b* extends obliquely with respect to the axial direction of the rotary shaft 12. The second intermediate passages 83*b* extend to approach each other from the downstream passages 82, respectively, toward the outer end surface 31*e* of the fixed base plate 31*a*.

Each intermediate passage 83 is defined by arranging the intermediate housing member 17 and the fixed scroll 31 to bring the facing surface 17*e* of the intermediate housing member 17 into contact with the outer end surface 31*e* of the fixed base plate 31*a* and connecting the downstream end of each first intermediate passage 83*a* to the upstream end of a corresponding second intermediate passage 83*b*. Thus, the intermediate passages 83 extend obliquely with respect to the axial direction of the rotary shaft 12. The intermediate passages 83 have a larger cross-sectional area than the upstream passages 81 and the downstream passages 82. Further, the intermediate passages 83 have a length longer than the upstream passages 81 and longer than the downstream passages 82. In the present embodiment, each injection passage 80 includes a muffler structure, i.e., a muffler. The muffler is formed by making the cross-sectional area of the intermediate passage 83 larger than those of the upstream passage 81 and the downstream passage 82. In other words, the muffler is defined by the intermediate passages 83, which have a larger cross-sectional area than the upstream passages 81 and the downstream passages 82.

Operation

The operation of the present embodiment will now be described.

For example, during high-load operation of the scroll compressor 10, the check valve 70 opens when refrigerant having the intermediate pressure is introduced from the external refrigerant circuit 25 into the introduction port 60. Specifically, when the refrigerant having the intermediate pressure is introduced from the external refrigerant circuit 25 into the introduction port 60, the refrigerant having the intermediate pressure passes through the introduction port 60 to flow into the first chamber 611 in the intermediate pressure chamber 61 and flow toward the inside of the valve hole 71*h*.

The refrigerant having the intermediate pressure that has flowed toward the inside of the valve hole 71*h* pushes away the reed valve 72*v*. As a result, the reed valve 72*v* opens the valve hole 71*h* so that the check valve 70 is opened. Then, the refrigerant having the intermediate pressure flows into the second chamber 612 of the intermediate pressure chamber 61 through the valve hole 71*h*, and is introduced into each of two of the compression chambers 33 that are in a process of compression through a corresponding injection passage 80. This increases the flow rate of the refrigerant in the compression chambers 33 and thus enhances the performance of the scroll compressor 10 during the high-load operation.

The check valve 70 is closed to prevent refrigerant from flowing from the injection passages 80 to the introduction port 60 through the intermediate pressure chamber 61. Specifically, when the refrigerant having the intermediate pressure is no longer introduced from the external refrigerant circuit 25 into the introduction port 60, the reed valve 72*v* returns to its original position before being pushed away by the refrigerant having the intermediate pressure, thereby closing the valve hole 71*h*. This causes the check valve 70 to be closed. Then, the refrigerant that has flowed from the compression chambers 33 to the second chamber 612 through the injection passages 80 is prevented from flowing to the first chamber 611 through the valve hole 71*h*, and the refrigerant is prevented from flowing back from the introduction port 60 to the external refrigerant circuit 25. Thus, the check valve 70 prevents the refrigerant from flowing back from the compression chambers 33 to the intermediate pressure chamber 61 through the injection passages 80.

In the scroll compressor 10, pulsation occurs in the compression chambers 33 due to pressure fluctuation in the compression chambers 33 caused when a compression stroke of refrigerant is performed in the compression chambers 33. Since the intermediate passages 83 have a larger cross-sectional area than the upstream passages 81 and the downstream passages 82 and have a length longer than the upstream passages 81 and the downstream passages 82, a muffler effect is produced in the intermediate passages 83 of the injection passage 80. Accordingly, even if the pulsation that has occurred in the compression chambers 33 attempts to be transmitted to the intermediate pressure chamber 61 through the injection passage 80, the pulsation is effectually reduced by utilizing the muffler effect of the intermediate passages 83. This limits the occurrence of pulsation in the intermediate pressure chamber 61 and limits vibration of the reed valve 72*v* of the check valves 70 that would result from the pulsation.

Advantages

The above embodiment provides the following advantages.

(1) Each injection passage 80 includes the muffler. Thus, the muffler effect is produced in each injection passage 80. Thus, even if pulsation occurs in the compression chambers 33 due to pressure fluctuation in the compression chambers 33 generated when the compression stroke of refrigerant is performed in the compression chambers 33 and the pulsation generated in the compression chambers 33 attempts to be transmitted to the intermediate pressure chamber 61 through the injection passages 80, the pulsation is effectually reduced by using the muffler effect. Thus, the occurrence of pulsation in the intermediate pressure chamber 61 is limited. As a result, the generation of noise that would result from the pulsation occurring in the intermediate pressure chamber 61 is limited.

(2) The muffler is formed by making the cross-sectional areas of the intermediate passages 83 larger than those of the upstream passages 81 and the downstream passages 82. In other words, the muffler is defined by the intermediate passages 83, which have a larger cross-sectional area than the upstream passages 81 and the downstream passages 82. Such a muffler is suitable for the injection passages 80.

(3) The intermediate passages 83 have a length longer than the upstream passages 81 and the downstream passages 82. Accordingly, as compared to when, for example, the lengths of the intermediate passages 83 are less than or equal to the lengths of the upstream passages 81 or the downstream passages 82, the muffler effect in the intermediate passages 83 is increased.

(4) The intermediate passages 83 extend obliquely with respect to the axial direction of the rotary shaft 12. Thus, as compared with when the intermediate passages 83 extend in the axial direction of the rotary shaft 12, an increase in the size of the scroll compressor 10 in the axial direction of the rotary shaft 12 is limited even if the intermediate passages 83 are lengthened. This maximizes the length of each intermediate passage 83 while reducing the size of the scroll compressor 10 in the axial direction of the rotary shaft 12, thereby increasing the muffler effect in the intermediate passage 83. This further reduces the pulsation effectually by using the muffler effect in the intermediate passage 83.

(5) The upstream passages 81 have a larger cross-sectional area than the downstream passages 82. Accordingly, as compared with when, for example, the cross-sectional area of each upstream passage 81 is less than or equal to that of a corresponding downstream passage 82, a smaller amount of pressure loss is produced when the refrigerant having the intermediate pressure is introduced from the intermediate pressure chamber 61 to the compression chambers 33 through the injection passage 80.

(6) Each intermediate passage 83 is defined by arranging the intermediate housing member 17 and the fixed scroll 31 to bring the facing surface 17*e* of the intermediate housing member 17 into contact with the outer end surface 31*e* of the fixed base plate 31*a* and connecting each first intermediate passage 83*a* to a corresponding second intermediate passage 83*b*. Such a configuration is suitable for a configuration for forming each of the injection passages 80 including the upstream passages 81, the downstream passages 82, and the intermediate passages 83.

(7) Pulsation is effectually reduced by utilizing the muffler effect of each intermediate passage 83. This avoids situations in which, for example, pulsation results in vibration of an external pipe of the external refrigerant circuit 25, which introduces refrigerant having the intermediate pressure into the introduction port 60.

(8) The occurrence of pulsation in the intermediate pressure chamber 61 is limited. Thus, the vibration of the reed valve 72*v* of the check valve 70 that would arise from pulsation is limited. This limits the generation of noise resulting from the vibration of the reed valve 72*v* of the check valve 70 that would be caused by the pulsation occurring in the intermediate pressure chamber 61.

(9) The vibration of the reed valve 72*v* of the check valve 70 that would arise from the pulsation occurring in the intermediate pressure chamber 61 is limited. This limits situations in which the reed valve 72*v* of the check valve 70 is unintentionally opened and closed. Thus, the durability of the check valve 70 is enhanced.

Modifications

The above embodiment may be modified as follows. The above embodiment and the following modifications can be combined as long as the combined modifications remain technically consistent with each other.

Figure 8:
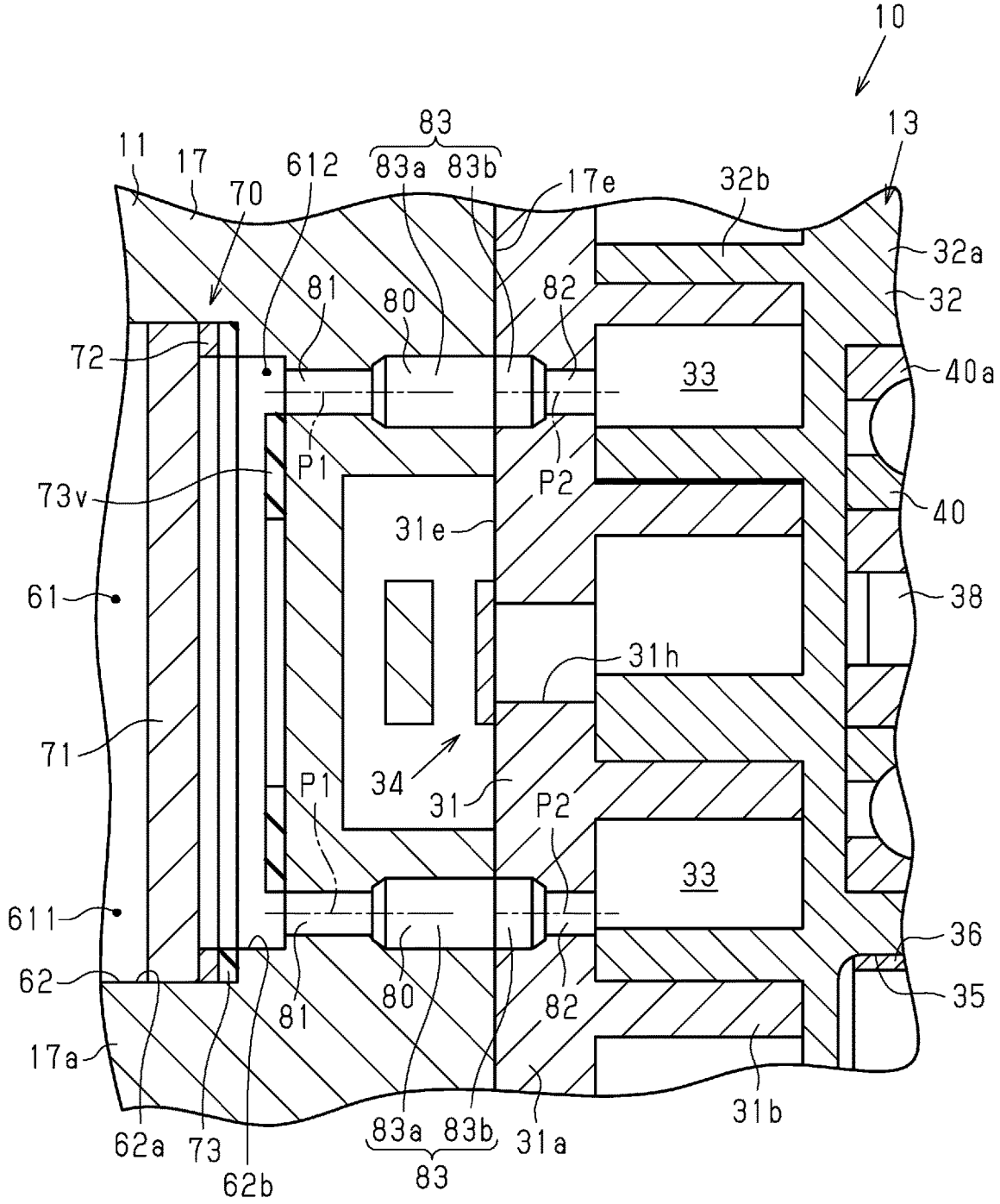
FIG. 8 is an enlarged cross-sectional view showing a part of a scroll compressor according to a modification.

As shown in FIG. 8, each intermediate passage 83 may extend in the axial direction of the rotary shaft 12. In this case, for example, the axis of each first intermediate passage 83*a* coincides with the axis P1 of a corresponding upstream passage 81. Further, the axis of each second intermediate passage 83*b* coincides with the axis P2 of a corresponding downstream passage 82. Furthermore, the axis P1 of each upstream passage 81 and the axis P2 of a corresponding downstream passage 82 coincide with each other.

As shown in FIG. 8, the hole diameter of each upstream passage 81 may be equal to that of a corresponding downstream passage 82. Thus, the cross-sectional area of each upstream passage 81 may be may be equal to that of a corresponding downstream passage 82.

In the embodiment, the hole diameter of each upstream passage 81 may be smaller than that of a corresponding downstream passage 82. Thus, the cross-sectional area of each upstream passage 81 may be smaller than that of a corresponding downstream passage 82.

In the embodiment, for example, the first intermediate passages 83*a* may respectively extend to approach each other from the upstream passages 81 toward the facing surface 17*e* of the intermediate housing member 17. In this case, the second intermediate passages 83*b* respectively extend away from the downstream passages 82 toward the outer end surface 31*e* of the fixed base plate 31*a*. Each intermediate passage 83 is defined by arranging the intermediate housing member 17 and the fixed scroll 31 to bring the facing surface 17*e* of the intermediate housing member 17 into contact with the outer end surface 31*e* of the fixed base plate 31*a* and connecting the downstream end of each first intermediate passage 83*a* to the upstream end of a corresponding second intermediate passage 83*b*. The intermediate passages 83 may extend obliquely with respect to the axial direction of the rotary shaft 12 in this manner.

In the embodiment, for example, the second intermediate passages 83*b* do not have to be defined in the fixed base plate 31*a*. Instead, the entire intermediate passages 83 may be defined in the intermediate housing member 17.

In the embodiment, for example, the first intermediate passages 83*a* do not have to be defined in the intermediate housing member 17. Instead, the entire intermediate passages 83 may be defined in the fixed base plate 31*a*.

In the embodiment, the muffler may be configured such that, for example, the injection passages 80 do not respectively include the upstream passages 81 and the intermediate passages 83 open in the intermediate pressure chamber 61. This allows the intermediate passages 83 to produce the muffler effect.

In the embodiment, the muffler may be configured such that, for example, the injection passage 80 does not include the downstream passages 82 and the intermediate passages 83 open in the compression chamber 33. This allows the intermediate passages 83 to produce the muffler effect.

In the embodiment, the scroll compressor 10 may be configured such that the circumferential wall 17*b* of the intermediate housing member 17 does not cover the compression mechanism 13 on the radially outer side of the rotary shaft 12. For example, the fixed volute wall 31*b* may protrude from the inner surface of the end wall 17*a* of the intermediate housing member 17, and the circumferential wall 17*b* of the intermediate housing member 17 may function as a fixed outer circumferential wall that surrounds the fixed volute wall 31*b*. That is, a part of the intermediate housing member 17 may function as the fixed scroll 31. In this case, the part of the intermediate housing member 17 that functions as the fixed scroll 31 is included in the compression mechanism 13.

In the embodiment, the shape of each reed valve 72*v* is not particularly limited. In short, the distal end portion of the reed valve 72*v* simply needs to be shaped such that the valve hole 71*h* can be opened and closed.

In the embodiment, the shape of each valve hole 71*h* is not particularly limited. In this case, the shape of the distal end portion of the reed valve 72*v* needs to be changed such that the valve hole 71*h* can be opened and closed.

In the embodiment, the check valve 70 does not have to include the reed valve 72*v*. For example, the check valve 70 may include a spool valve. The spool valve reciprocates between an open position and a closed position, based on the relationship between the biasing force of a coil spring and the pressure of refrigerant having the intermediate pressure from the introduction port 60. Thus, if the check valve 70 prevents the refrigerant from flowing back from the compression chambers 33 to the intermediate pressure chamber 61 through the injection passages 80, the check valve 70 may have any configuration.

In the embodiment, each injection passage 80 does not need to have the form of a circular hole and may have the form of, for example, an elliptical hole or a square hole.

In the embodiment, the scroll compressor 10 does not have to be driven by the electric motor 14 and may be driven by, for example, the engine of a vehicle.

In the embodiment, the scroll compressor 10 is used in a vehicle air conditioner. Instead, the scroll compressor 10 may be, for example, mounted on a fuel cell electric vehicle to compress air (fluid) supplied to a fuel cell using the compression mechanism 13.

The invention claimed is:

1. A scroll compressor, comprising:

a housing including a suction port into which refrigerant is drawn and a discharge port out of which the refrigerant is discharged;

a rotary shaft accommodated in the housing and supported by the housing to be rotatable about a rotation axis; and a compression mechanism accommodated in the housing, the compression mechanism including a fixed scroll fixed to the housing and a movable scroll configured to orbit as the rotary shaft rotates, wherein the compression mechanism includes a compression chamber configured to compress the refrigerant drawn when the fixed scroll meshes with the movable scroll, the housing includes an intermediate pressure chamber into which refrigerant having an intermediate pressure is introduced from an external refrigerant circuit, the intermediate pressure being higher than a suction pressure of the refrigerant drawn into the compression chamber and lower than a discharge pressure of the refrigerant discharged from the compression chamber, the intermediate pressure chamber and the compression chamber in a process of compression are connected to each other by an injection passage, a check valve is located in the intermediate pressure chamber and is configured to prevent the refrigerant from flowing back from the compression chamber to the intermediate pressure chamber through the injection passage, and the injection passage includes a muffler, wherein the injection passage includes:

an upstream passage that opens in the intermediate pressure chamber;

a downstream passage that opens in the compression chamber; and an intermediate passage that connects the upstream passage to the downstream passage, and the muffler is defined by the intermediate passage, wherein the intermediate passage has a larger cross-sectional area than the upstream passage and the downstream passage.

2. The scroll compressor according to claim 1, wherein the intermediate passage has a length longer than the upstream passage and the downstream passage.

3. The scroll compressor according to claim 1, wherein the intermediate passage extends obliquely with respect to an axial direction of the rotary shaft.

4. The scroll compressor according to claim 1, wherein the upstream passage has a larger cross-sectional area than the downstream passage.

5. A scroll compressor, comprising:

a housing including a suction port into which refrigerant is drawn and a discharge port out of which the refrigerant is discharged;

a rotary shaft accommodated in the housing and supported by the housing to be rotatable about a rotation axis; and a compression mechanism accommodated in the housing, the compression mechanism including a fixed scroll fixed to the housing and a movable scroll configured to orbit as the rotary shaft rotates, wherein the compression mechanism includes a compression chamber configured to compress the refrigerant drawn when the fixed scroll meshes with the movable scroll, the housing includes an intermediate pressure chamber into which refrigerant having an intermediate pressure is introduced from an external refrigerant circuit, the intermediate pressure being higher than a suction pressure of the refrigerant drawn into the compression chamber and lower than a discharge pressure of the refrigerant discharged from the compression chamber, the intermediate pressure chamber and the compression chamber in a process of compression are connected to each other by an injection passage, and the injection passage includes a muffler, wherein the injection passage includes:

an upstream passage that opens in the intermediate pressure chamber;

a downstream passage that opens in the compression chamber; and an intermediate passage that connects the upstream passage to the downstream passage, and the muffler is defined by the intermediate passage, wherein the intermediate passage has a larger cross-sectional area than the upstream passage and the downstream passage, wherein the intermediate passage includes:

a first intermediate passage connected to the upstream passage; and a second intermediate passage connected to the downstream passage, the fixed scroll includes:

a fixed base plate; and a fixed volute wall arranged upright from the fixed base plate, the housing includes a facing surface facing an outer end surface of the fixed base plate, the outer end surface being an end surface on a side opposite to the fixed volute wall, the housing includes the upstream passage and the first intermediate passage, the first intermediate passage opens in the facing surface, the fixed base plate includes the second intermediate passage and the downstream passage, the second intermediate passage opens in the outer end surface, and the intermediate passage is defined by arranging the housing and the fixed scroll to bring the facing surface into contact with the outer end surface and connecting the first intermediate passage to the second intermediate passage.

* * * * *